US011465787B2

(12) United States Patent
Battistoni et al.

(10) Patent No.: US 11,465,787 B2
(45) Date of Patent: Oct. 11, 2022

(54) MOVABLE WRAPPING MACHINE

(71) Applicant: NOXON S.P.A., Acquaviva Gualdicciolo (SM)

(72) Inventors: Andrea Battistoni, Acquaviva Gualdicciolo (SM); Federico Spallino, Acquaviva Gualdicciolo (SM)

(73) Assignee: NOXON S.P.A., Acquviva Gualdicciolo (SM)

( * ) Notice: Subject to any disclaimer, the term of this patent is extended or adjusted under 35 U.S.C. 154(b) by 0 days.

(21) Appl. No.: 17/251,905

(22) PCT Filed: Jun. 11, 2019

(86) PCT No.: PCT/IB2019/054852
§ 371 (c)(1),
(2) Date: Dec. 14, 2020

(87) PCT Pub. No.: WO2020/012265
PCT Pub. Date: Jan. 16, 2020

(65) Prior Publication Data

US 2021/0253284 A1 Aug. 19, 2021

(30) Foreign Application Priority Data

Jun. 12, 2018 (IT) ..... 102018000006249

(51) Int. Cl.
*B65B 57/00* (2006.01)
*B65B 11/02* (2006.01)
*B65B 67/08* (2006.01)

(52) U.S. Cl.
CPC ..... *B65B 11/025* (2013.01); *B65B 57/00* (2013.01); *B65B 67/08* (2013.01)

(58) Field of Classification Search
USPC ..... 53/588
See application file for complete search history.

(56) References Cited

U.S. PATENT DOCUMENTS 9,896,229 B1 * 2/2018 Pierson ..... B65B 11/045
2016/0096645 A1 * 4/2016 Lancaster, III ..... B65B 59/001 53/461
2019/0002138 A1 1/2019 Laghi

FOREIGN PATENT DOCUMENTS

KR 10-1755004 7/2017
KR 101755004 B1 * 7/2017 ..... B65B 11/025
(Continued)

OTHER PUBLICATIONS

International Search Report dated Aug. 12, 2019 in International (PCT) Application No. PCT/IB 2019/054852.

*Primary Examiner* — Chinyere J Rushing-Tucker
(74) *Attorney, Agent, or Firm* — Wenderoth, Lind & Ponack, L.L.P.

(57) ABSTRACT

A manually propelled wrapping machine movable by an operator around a load to wrap the latter with a film of plastic material, comprises a carriage provided with a plurality of supporting wheels and a guiding bar usable by the operator to push and direct the carriage at least along a wrapping path around the load; a column fixed to the carriage and slidably supporting an unwinding unit for dispensing the film; an actuating device for moving the unwinding unit along the column with a specific movement speed; the wrapping machine further includes a first sensor device associated with at least one wheel of said wheels for detecting and measuring a rotation speed of the latter, and a control unit for receiving a signal related to the rotation speed from the first sensor device and calculating an advancing speed of the carriage along the wrapping path and for controlling the actuating device so as to adjust the movement speed of the unwinding unit as a function of the advancing speed so as to wrap the load with a defined wrapping configuration.

8 Claims, 2 Drawing Sheets

(56) References Cited

FOREIGN PATENT DOCUMENTS

| | | | | |
|---|---|---|---|---|
| WO | 2013/050832 | | 4/2013 | |
| WO | WO-2013050832 | A1 * | 4/2013 | ..... B65B 11/025 |
| WO | 2017/025870 | | 2/2017 | |

* cited by examiner

MOVABLE WRAPPING MACHINE

The invention relates to movable or self-propelled wrapping machines arranged to wrap an extensible film of plastic material around a load consisting in a product or a plurality of products arranged on a pallet such as to obtain a so-called palletized load. In particular the invention relates to a manually propelled wrapping machine.

Self-propelled wrapping machines, also designated self-propelled wrapping robots, are machines generally used to wrap loads of variable shapes and sizes and limited in number, typically in environments or places where fixed or static wrapping machines cannot be used due to their volumes and/or room availability. Loads are generally formed by pallets whereon a plurality of products and/or objects, also having different sizes and shapes, are arranged more or less properly overlaid. In other cases the wrapping, normally for protection purposes, concerns directly the product, which is generally large.

Among self-propelled wrapping machines, they are known wrapping machines that are manually propelled i.e. that require an operator in charge of pushing and moving them around the load such as to wrap the latter with the extensible plastic film. The operator also fixes the film to the load (typically by knotting an initial edge of the film to the pallet) in one initial step of the wrapping, and cuts the film at the end of the wrapping.

These manually actuated wrapping machines typically include a cart or carriage provided with fixed rear wheels and front pivoting wheels and provided with a helm or guiding bar used by the operator to push and direct the carriage. The latter supports a vertical column along which an unwinding or dispensing unit that houses a reel of plastic film is movable with alternate rectilinear motion. The unwinding unit can be provided with a couple of pre-stretching rollers arranged to unwind the film from the reel and therefore to pre-stretch or elongate it of a predefined percentage, and one or more return rollers to deviate the film towards the load to be wrapped.

The unwinding unit can be manually propelled along the column by the operator, typically by a crank mechanism, or semi-automatically, by an electric actuator driven by the operator. In the wrapping procedure the combination of the alternative linear movement (rise/descent) of the unwinding unit along the vertical column and of the rotation of the self-propelled machine around the load allows to wrap the film around the latter such as to form a series of strips or bands overlapped and intersected. The plastic film is wrapped such as to wrap the load completely throughout its sides.

A disadvantage of the known manually propelled wrapping machines is that the movement speed of the unwinding unit movable, rising and descending, along the column is not related to the advancing speed of the machine, which is pushed by the operator around the load. In particular, whereas the movement speed of the unwinding unit can be set acting on the electric actuator and it is thus substantially defined and constant throughout the whole wrapping procedure, the advancing speed depends on the operator employed to drive the machine and on how the operator pushes the machine during the whole wrapping procedure. With the known wrapping machines it is not possible to control precisely and constantly the amount of film laid on the load, i.e. the number of film wraps and of overlaps between contiguous film strips. Consequently, even with loads being equal (in terms of size, type and number of products), different and uneven wrappings are obtained, i.e. having different characteristics (number of wrappings, overlaps) and thus not often acceptable both from a qualitative point of view (as the wrapping and stabilization of the load are not regular, constant and reiterative) and from a purely aesthetical point of view (different arrangement and number of film bands overlapped and intersected).

An object of the invention is to improve the known manually propelled wrapping machines arranged to wrap a load with a film of extensible plastic material.

Another object is to implement a manually propelled wrapping machine that makes it possible to lay down a definite amount of film on the load i.e. to wrap the latter with a determined number of film strips or bands and/or with a predefined overlapping value of the contiguous film strips.

A further object is to implement a manually propelled wrapping machine that makes it possible to wrap substantially evenly and regularly the film around the load regardless of the operator employed and/or his way of moving the machine during the wrapping process. Such and other objects are achieved by a manually propelled wrapping machine according to one or more of the hereinafter reported claims.

The invention will be better understood and implemented referring to the enclosed drawings which illustrate some exemplary and non-limiting embodiments, wherein.

Figure 1:
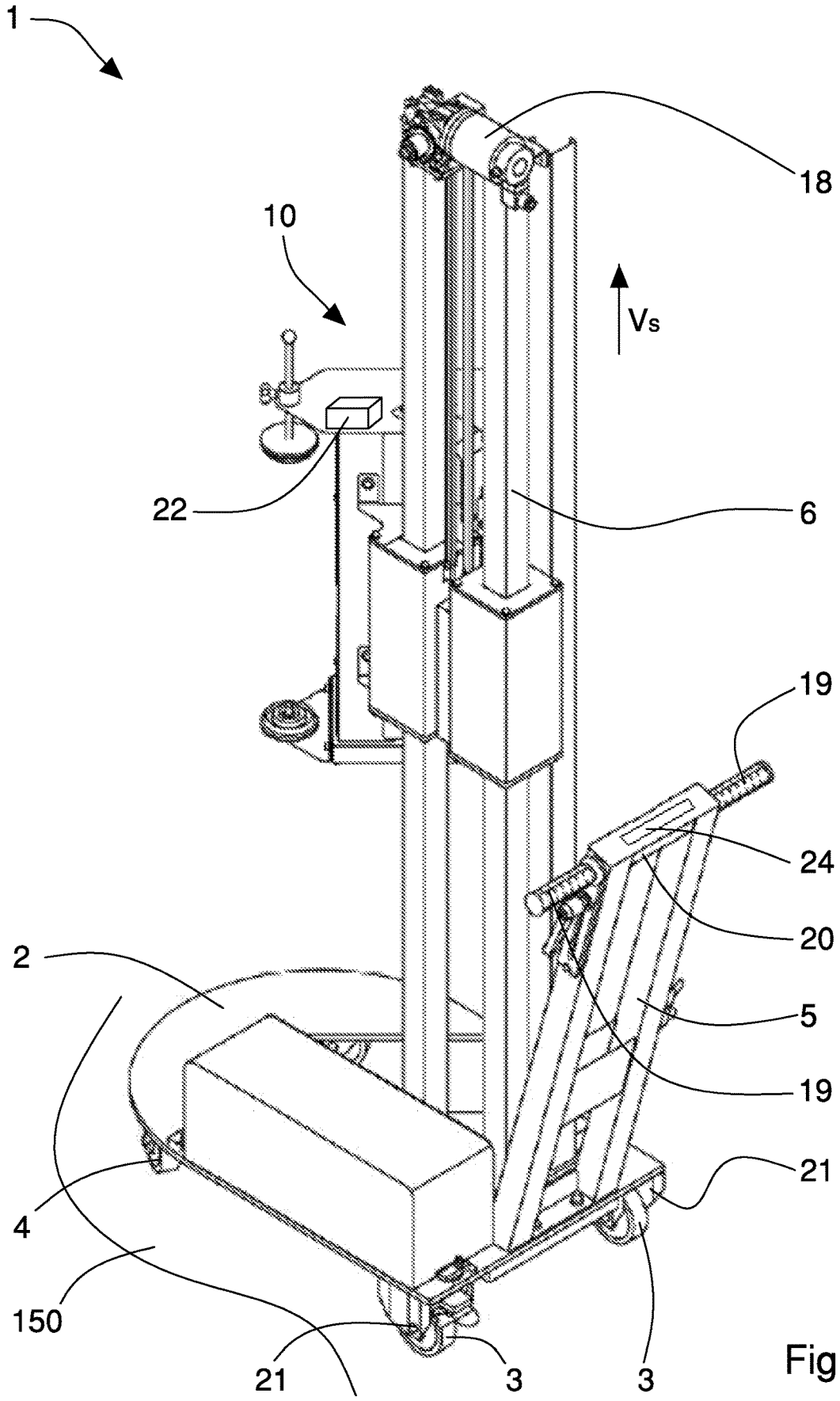
FIG. 1 is a perspective view of the manually propelled wrapping machine of the invention.
Figure 2:
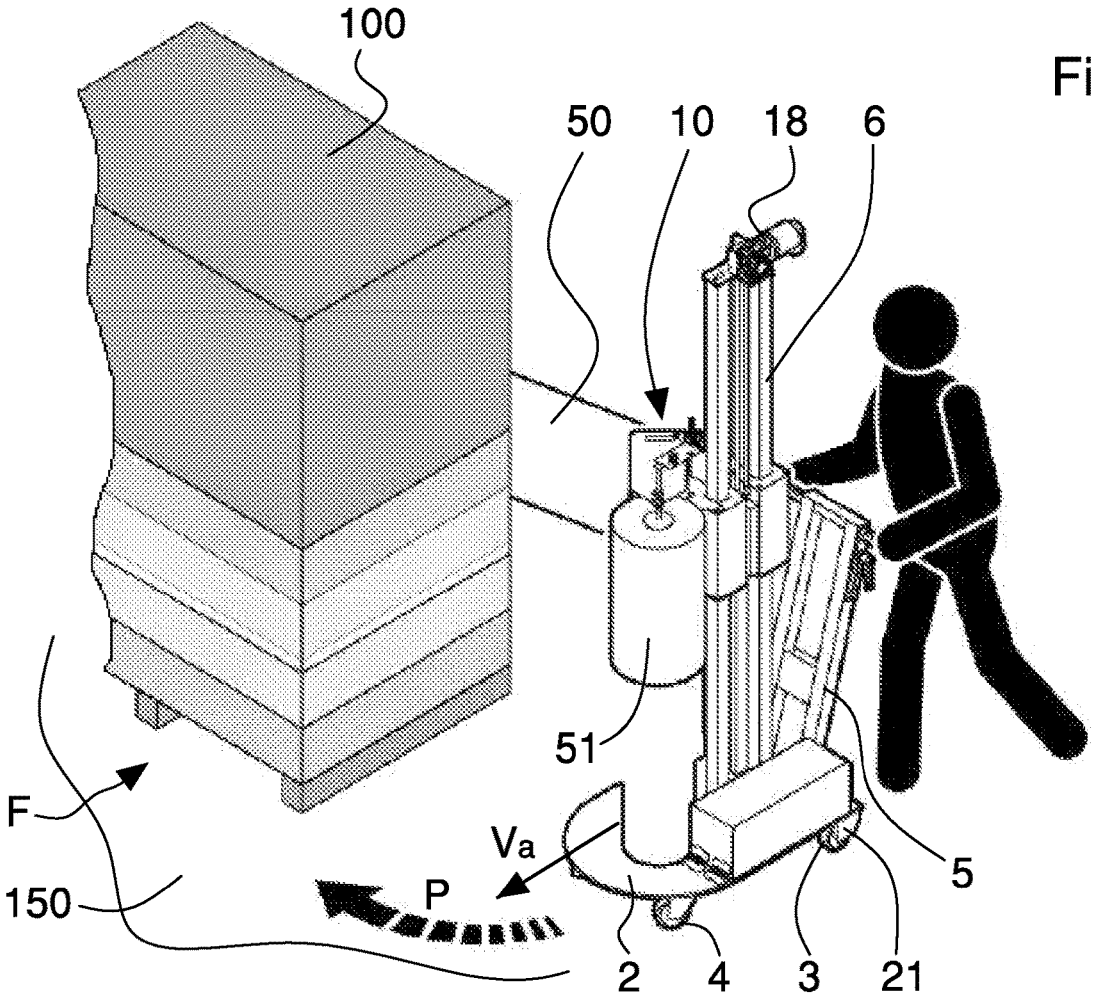
FIG. 2 is a perspective view of the machine of FIG. 1 pushed by an operator in a process for wrapping a load.

Referring to FIGS. 1 and 2, a manually propelled wrapping machine 1 is shown, in particular so called self-propelled, movable by an operator around a load 100 to wrap the latter with a film 50 of plastic material.

The wrapping machine 1 comprises a self-propelled or movable carriage 2 provided with a plurality of supporting wheels 3, 4 and a guiding bar 5, or helm, usable by the operator to push and direct the carriage 2 in particular at least along a wrapping path P around the load 100 during the wrapping.

A column 6, substantially vertical, is fixed to the carriage 2 and slidably supports an unwinding unit 10 arranged to dispense the film 50.

An actuating device 18 is provided to move the unwinding unit 10 along the column 6 with a specific movement speed Vs, in particular according to a first movement direction (rise) and/or a second movement direction (descent).

The wrapping machine 1 further comprises a first sensor device 21, associated with at least one wheel of the aforesaid plurality of wheels 3, 4 and arranged to detect and measure a rotation speed of said wheel, and a control unit 20 adapted to receive a signal related to the measured rotation speed of the wheel from the first sensor device 21 and calculate an advancing speed Va of the carriage 2, in particular along the wrapping path P, and thus to control the actuating device 18 so as to adjust the movement speed Vs of the unwinding unit 10 as a function of the advancing speed Va so as to wrap the load 100 with a defined wrapping configuration F. More precisely, the control unit 20 controls and adjusts the movement speed Vs in the two movement directions of the unwinding unit 10 so that, regardless of the value of the advancing speed Va of the carriage and its variation throughout the whole wrapping process, the load 100 is wrapped with a predefined number of film wraps and with predefined overlapping values between continuous strips or bands of film. In other words, the aleatory nature of the wrapping configuration F of the load 100 determined by manually moving the wrapping machine 1 by the operator is avoided.

The control unit 20 can be programmed in order to allow the operator to adjust and set a variation of the movement speed Vs as a function of the advancing speed Va so as to change the wrapping configuration i.e. to change an amount of film 50 laid on the load 50. In other words, acting on the control unit 20, the advancing speed Va being equal, the operator can vary the movement speed Vs of the unwinding unit 10 to obtain different wrapping configurations F on the load 100.

The control unit 20 is provided with a control panel 24 positioned on an end of the guiding bar 5, in particular interposed between two handles 19 of the latter, which allows to actuate and control the wrapping machine 1, in particular the actuating device 18.

In the illustrated embodiment, the carriage 2 comprises a pair of fixed first wheels 3, i.e. not pivoting, and at least one pivoting second wheel 4, for example two, which allow to steer the carriage. The fixed first wheels 3 are for example the rear wheels placed at a rear portion of the carriage 2 which the guiding bar 5 is fixed to, while the pivoting second wheels 4 are the front wheels placed at a front portion of the carriage 2.

The first sensor device 21 comprises at least a rotation sensor associated with one wheel of the first wheels 3 and arranged to measure at least an angular or rotation speed of the wheel.

The rotation sensor is a known sensor and not described in detail, for example a rotation speed sensor of inductive, optical, Hall effect type, etcetera.

Preferably, the first sensor device 21 comprises a pair of rotation sensors each of which is associated with a respective first wheel 3. Thereby the control unit which receives from the two sensors the signals related to the measured rotation speeds of the wheels can calculate in a more precise and real way the advancing speed Va of the carriage 2.

The wrapping machine 1 of the invention also comprises a second sensor device 22 arranged to detect a height of the load 100 with respect to a supporting plane 150 of the load 100 and of the wrapping machine 1 and to send a corresponding signal to the control unit 20 in order to stop or reverse a movement of said unwinding unit 10 along the column 6, in the first movement direction (rise) or in the second movement direction (descent). Alternatively, stopping or reversing the movement of the unwinding unit 10 can be actuated manually by the operator acting on a control panel of the control unit 20.

Figure 3:
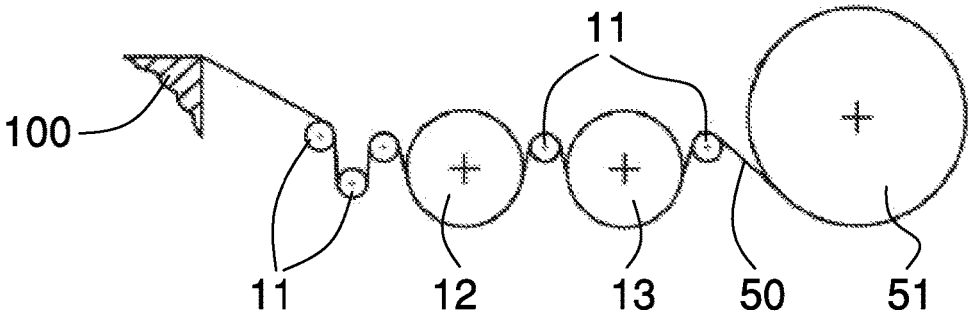
FIG. 3 is a schematic plan view of an unwinding unit of the machine of FIG. 1.
Figure 4:
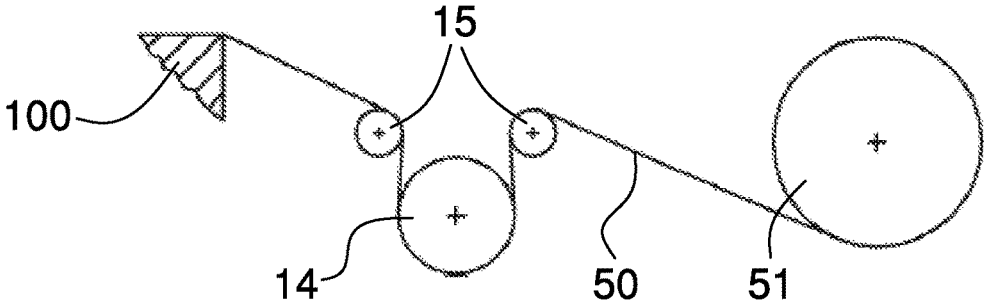
FIG. 4 is a schematic plan view of an unwinding unit of a variant of the machine of FIG. 1.

In one embodiment of the wrapping machine 1, the unwinding unit 10 comprises a reel 51 of film 50, a plurality of guiding rollers 11 and a couple of powered pre-stretching rollers 12, 13, i.e. driven in rotation about respective longitudinal axes by a motor arrangement (not shown in the figures), and arranged to unwind and pre-stretch the film 50 before wrapping it around the load 100 (FIG. 3). Actuating and adjusting the motor arrangement of the pre-stretching rollers 12, 13 is performed by the operator by means of the control panel 24 of the control unit 20. Alternatively, in one variant of the wrapping machine of the invention, the unwinding unit 10 comprises the reel 51 of the film 50, a plurality of guiding rollers 15 and a friction roller 14 arranged to elongate or stretch the film 50 while wrapping it around the load 100 (FIG. 4).

The functioning of the wrapping machine 1 of the invention provides an initial step of adjusting wherein the operator, through the control panel 24 of the control unit 20, sets up the variation of the movement speed Vs of the unwinding unit 10 as a function of the advancing speed Va of the carriage 2 i.e. he sets a desired wrapping configuration F or amount of film 50 to be laid down on the load 100.

After fixing an initial edge of the film 50 to the load 100, for example to a lower portion of the supporting pallet, the operator starts pushing the wrapping machine 1 around the load 100 following a wrapping path P and actuating at the same time through the control panel 24 the actuating device 18 which moves the unwinding unit 10 along the column 6 in the first movement direction (rise).

According to the selected wrapping configuration for the load 100, when the unwinding unit 10 reaches along the column 6 the top of the load 100 detected by the second sensor device 22 (that measures the height thereof), the control unit 20 controlling the actuating device 18 can decide to stop the unwinding unit 10 (end of wrapping of the load) or to reverse the movement of the latter into the second movement direction (descent).

Alternatively, stopping or reversing the movement of the unwinding unit 10 can be actuated manually by the operator acting on a control panel 24 of the control unit 20.

Once wrapping is ended, the operator cuts the film 50 fixing the resulting end edge to the load 100.

Thanks to the manually propelled wrapping machine 1 of the invention it is thus possible to lay down a definite amount of film on the load 100 i.e. to wrap the latter with an established number of strips or bands of the film 50 and/or with a predefined value of overlapping of the contiguous film bands. More precisely, the wrapping machine 1 allows to wrap the film 50 around the load 100 in a substantially even and regular way regardless of the operator employed and/or its way of moving the machine around the load during the wrapping process.

It is therefore possible to obtain, with equal or similar loads (in terms of size, type and number of products), even and regular wraps, i.e. having equal characteristics (number of wraps, overlaps) and thus acceptable both from a qualitative and aesthetical point of view.

The invention claimed is:

1. A manually propelled wrapping machine movable by an operator around a load to wrap the load with a film of plastic material, the manually propelled wrapping machine comprising:

a carriage provided with a plurality of supporting wheels and a guiding bar usable by the operator to push and direct said carriage at least along a wrapping path around the load;

a column fixed to said carriage and slidably supporting an unwinding unit for dispensing the film;

an actuating device for moving said unwinding unit along said column with a specific movement speed;

a first sensor device associated with at least one supporting wheel of said plurality of supporting wheels for detecting and measuring a rotation speed of said at least one supporting wheel;

a control unit for receiving a signal related to the rotation speed from said first sensor device and calculating an advancing speed of said carriage along the wrapping path and for controlling said actuating device so as to adjust the movement speed of said unwinding unit as a function of the advancing speed so as to wrap the load with a defined wrapping configuration.

2. The manually propelled wrapping machine according to claim 1, wherein said plurality of supporting wheels comprises a pair of fixed first wheels and at least one pivoting second wheel, and said first sensor device comprises a rotation sensor associated with one of said fixed first wheels.

3. The manually propelled wrapping machine according to claim 2, wherein said first sensor device comprises a pair of rotation sensors each of which is associated with a respective one of said fixed first wheels.

4. The manually propelled wrapping machine according to claim 2, wherein said rotation sensor is a rotation speed sensor of inductive or optical or Hall effect type.

5. The manually propelled wrapping machine according to claim 1, further comprising a second sensor device for detecting a height of the load with respect to a supporting plane and sending a related signal to said control unit in order to stop or reverse a movement of said unwinding unit along said column.

6. The manually propelled wrapping machine according to claim 1, wherein said unwinding unit comprises a reel of the film, a plurality of guiding rollers and a plurality of pre-stretching rollers driven in rotation about respective longitudinal axes for unwinding and pre-stretching the film before wrapping the film around the load.

7. The manually propelled wrapping machine according to claim 1, wherein said unwinding unit comprises a reel of the film, a plurality of guiding rollers and a friction roller for stretching the film while wrapping the film around the load.

8. The manually propelled wrapping machine according to claim 1, wherein said control unit is programmable to adjust a variation of the movement speed as a function of the advancing speed so as to change the wrapping configuration.

* * * * *